United States Patent [19]

Kemnitz et al.

[11] Patent Number: 4,495,791

[45] Date of Patent: Jan. 29, 1985

[54] DENT REMOVING PNEUMATIC PULLER

[76] Inventors: Jerry E. Kemnitz, 1817 Skilak Cir., Anchorage, Ak. 99504; Ray A. Kemnitz, S. 918 Cannon, Spokane, Wash. 99204

[21] Appl. No.: 492,424

[22] Filed: May 6, 1983

[51] Int. Cl.[3] ..... B21D 1/12

[52] U.S. Cl. ..... 72/453.02; 72/705

[58] Field of Search ..... 72/453.02, 705

[56] References Cited

U.S. PATENT DOCUMENTS

| | | | |
|---|---|---|---|
| 3,744,291 | 7/1973 | Hagerty et al. | 72/705 |
| 3,922,902 | 12/1975 | Jarman . | |
| 4,072,042 | 2/1978 | Servin et al. . | |
| 4,073,181 | 2/1978 | Steinmann, Jr. | 72/705 |
| 4,122,699 | 10/1978 | Logsdon . | |
| 4,187,708 | 2/1980 | Champoux . | |

*Primary Examiner*—Lowell A. Larson

*Attorney, Agent, or Firm*—Wells, St. John & Roberts

[57] ABSTRACT

Disclosed is a pneumatic puller which can be used to pull dents from automobile bodies and for similar applications. The pneumatic puller has a threaded point which engages the material to be pulled. A pneumatic motor rotates the point so that the threads engage the sheet metal or other material being straightened. The puller also includes a piston which is driven rearwardly against a rear cap by the pressure of compressed gas. The hammering action of the piston against the rear cap forces the dented material to be pulled back into shape. A spring is used to return the piston within the tool. A piston control valve is used to control the supply of compressed gas to the piston. A pressure adjustment valve is used to adjust the pressure of the compressed gas applied to the piston thereby controlling the force of the pneumatic puller.

11 Claims, 6 Drawing Figures

DENT REMOVING PNEUMATIC PULLER

TECHNICAL FIELD

The technical field of this invention includes pneumatically powered pulling tools for removing dents from sheet materials such as sheet metal automobile body panels.

BACKGROUND OF THE INVENTION

Dented automobile bodies are a very common problem and one to which a great deal of time and effort is spent. For many years, body repairmen have used a tool called a slap hammer for removing dents from car and truck bodies. Slap hammers have a point which engages the body panel usually by screwing it into a small hole which has been previously drilled. The slap hammer has a very heavy weight which is slidable upon a strong shaft connected to this threaded point. The body repairman hammers the weight outwardly to pull the fender back into shape. U.S. Pat. No. 4,122,699 to Logsdon shows a typical type of slap hammer which is provided with a biscuspid rather than threaded engagement point. U.S. Pat. No. 4,072,042 to Servin et al discloses another slap hammer which has been specially adapted to be driven by a pneumatic wrench.

U.S. Pat. No. 3,922,902 to Jarman shows a dent removal device. The Jarman dent remover has a threaded engagement point which is manually screwed into the body panel usuing a handle wheel. The dent remover also includes a piston which slides within a cylinder. Compressed air is used to drive the piston backwardly to create the pulling force. Compressed air also drives the piston towards the front of the tool to engage a ball and socket arrangement which holds the piston near the front of the cylinder.

The current invention is directed to providing a durable, self contained unit which can very quickly and easily remove dents with a minimum of effort by a body repairman. The invention also provides a very safe tool which has a completely enclosed hammering weight and which can be very easily handled by body repairman. These and other objectives of the invention will be more fully disclosed in the description given below.

BRIEF DESCRIPTION OF THE DRAWINGS

A preferred and alternate embodiment of this invention is illustrated in the accompanying drawings, in which.

DETAILED DESCRIPTION OF THE PREFERRED EMBODIMENTS

In compliance with the constitutional purpose of the Patent Laws "to promote the progress of science and useful arts" (Article 1, Section 8), applicant submits the following disclosure of the invention.

Figure 1:
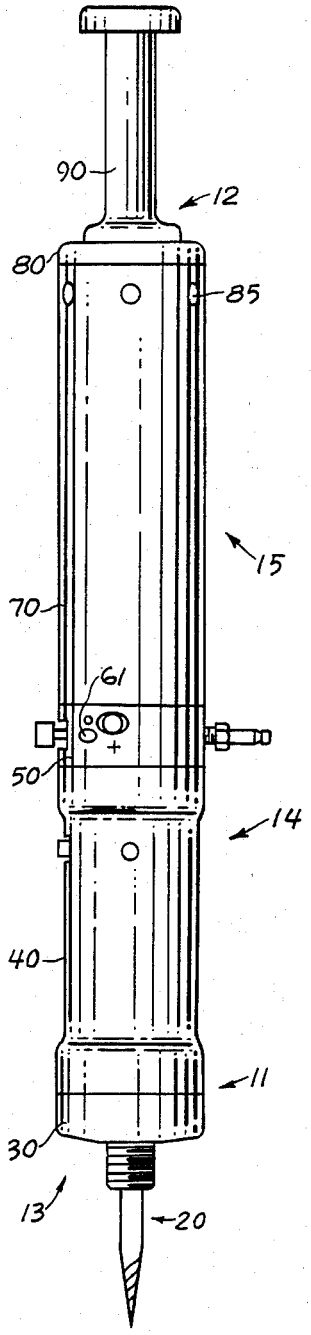
FIG. 1 is a side elevational view of the pneumatic puller of this invention.

FIG. 1 shows the pneumatic puller of this invention with a front end 11 and a rear end 12. At front end 11 is a rotatable point assembly 20. Point assembly 20 is held within the tool by front cap 30. The pneumatic puller has a structural housing which is generally referred to by the reference numeral 13. The structural housing comprises the front cap 30, motor casing 40, central block 50, piston tube 70 and rear cap 80. The structural housing can advantageously be provided with a handle 90.

Figure 5:
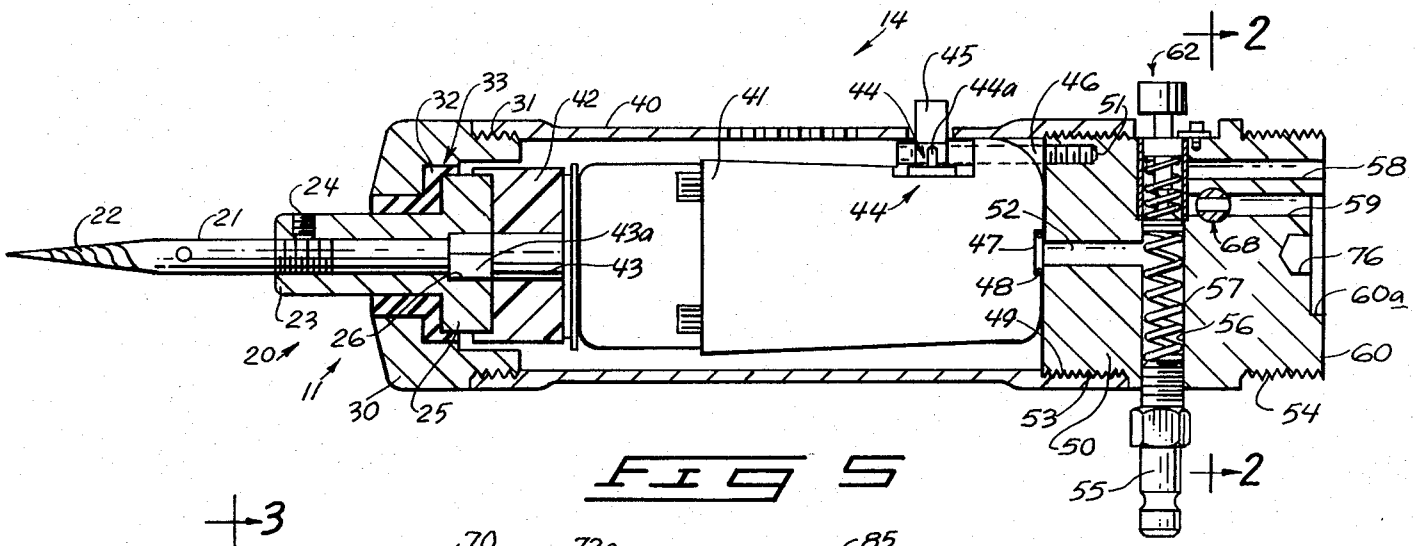
FIG. 5 is a longitudinal cross-sectional view of the front portion of the tool shown in FIG. 1.
Figure 6:
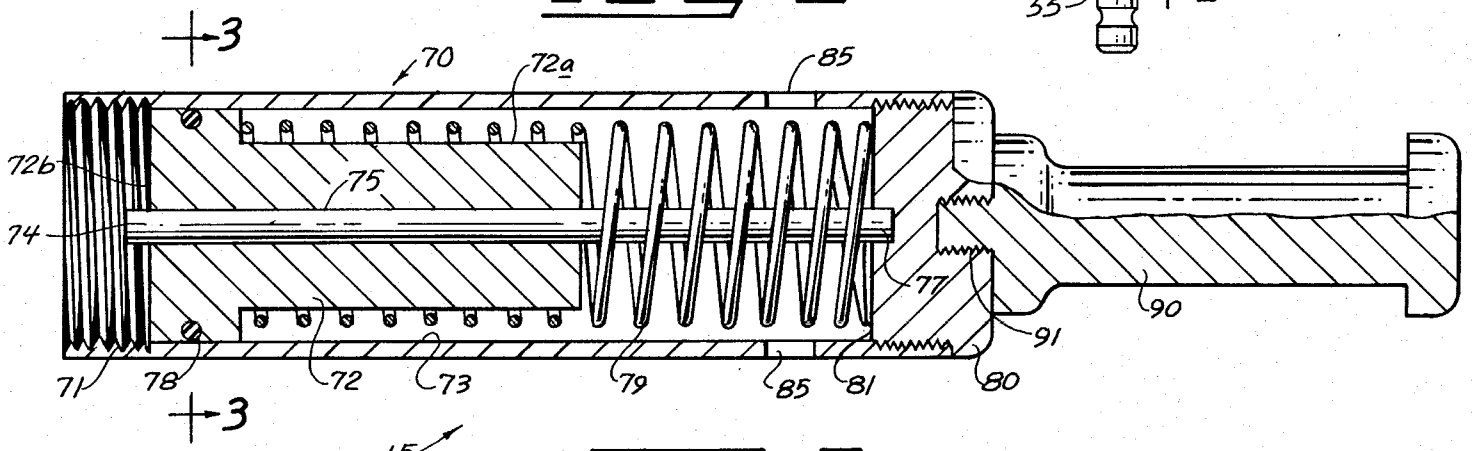
FIG. 6 is a longitudinal cross-sectional view of the rear portion of the tool shown in FIG. 1.

The internal components of the pneumatic puller are most clearly shown in FIGS. 5 and 6 which are longitudinal cross-sectional views. FIG. 5 is of the front portion 14 of the pneumatic puller and FIG. 6 is of the rear portion 15 of the pneumatic puller. FIG. 5 shows the rotating point assembly 20 at front end 11. Point assembly 20 includes a hardened tool steel point 21 which is provided with threads 22. A suitable point 21 for this pneumatic puller is manufactured by the J. R. Morgan Co. of Petaluma, Cal., Model No. JR-57. Point 21 is securely held within spool 23 using a set screw 24. Spool 23 is provided with a shoulder 25 to securely hold the point assembly 20 within front cap 30.

Front cap 30 is attached to motor casing 40 using threads 31. These parts could alternatively be connected using bolts, a bayonet mount or some other suitable connection as are well known in the art. Front cap 30 is provided with an anti-friction bushing 32 which supports the point assembly spool 23. Bushing 32 is preferably constructed from a graphite impregnated plastic or bronze material to obviate the need for repeated lubrication during use. Bushing 32 has a face 33 upon which the shoulder 25 bears to support the thrust load applied when the tool is pulling.

Motoring casing 40 spans between front cap 30 and central block 50 to act as a structural component and provide a continuous structural housing for the front portion of the pneumatic puller. A pneumatic motor means 41 is enclosed within the motor casing 40 and is connected to the central block 50 and rotating point assembly 20. Pneumatic motor means 41 can be any suitably sized pneumatically powered motor. A suitable pneumatic motor is the ⅜" square drive palm grip air wrench sold by Jet Equipment and Tools of Tacoma, Wash. as Model AW600.

Mounted on the front of the motor is a motor collar 42 which is preferably made from an anti-friction material such as graphite impregnated plastic or bronze. Motor collar 42 has a recessed face which receives the end of shoulder 25 of spool 23. Motor collar 42 does not rotate with the motor output shaft 43 but is instead held stationary and is used to support shoulder 25. Spool 23 of the point assembly includes a square receptacle 26 which receives the square end **43*a* of output shaft 43 of pneumatic motor 41**.

Motor 41 is provided pneumatic motor control means which is preferably two internal control valves 44 having control valve stems **44*a*. Depressing one of the control valve stems 44*a* causes the motor to rotate clockwise. Depressing the other control valve stem 44*a* causes the motor to turn in the opposite or counterclockwise direction. A rocker 45 is pivotally mounted to motor 41 using bolt 46 which extends through motor 41 and into opening 51 in central block 50. Rocker 45** can be rotated back and forth by the operator to cause the motor to turn in the desired direction.

The pneumatic motor means 41 receives compressed gas such as compressed air through motor passageway 52 in central block 50. Motor 41 has a mating gas opening 47 which abuts to motor passageway 52. An o-ring 48 or other sealing means is preferably provided to assure a tight seal.

Central block 50 acts as a component of structural housing 13 by connecting motor casing 40 to piston tube 70. Central block 50 is preferably provided with threads 53 which mate with internal threads 49 in the rear end of motor casing 40. Similarly, central block 50 is provided with threads 54 at the rear end of the block which mate with internal threads 71 in the forward end of piston tube 70. This threaded connection between central block 50 and piston tube 70 has been disconnected to show the front portion in FIG. 5 and the rear portion in FIG. 6 thereby providing greater detail. Many alternative means are available for connecting the central block 50 to motor casing 40 and piston tube 70. Examples are bolted connections, bayonet connections, and other similar mechanical connections which are well known in the art.

Central block 50 contains the compressed gas distribution system for the pneumatic puller. Compressed gas is supplied to the tool through a gas connection means 55 which is preferably a quick disconnect type fitting. Gas connection means 55 is preferably threaded into central block 50 at main cavity 56 in order to support spring or biasing means 57.

Figure 4:
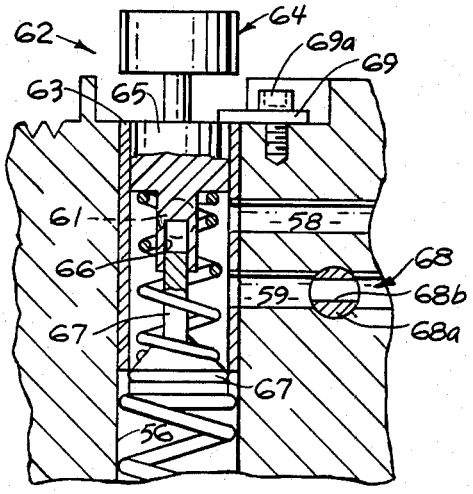
FIG. 4 is an enlarged partial cross-sectional view of the piston control valve shown in FIG. 5.

The gas distribution system includes main cavity 56 which preferably extends through the tool. Motor passageway 52 branches off of main cavity 56 to supply compressed gas to motor means 41. Piston exhaust passageway 58 and piston supply passageway 59 also branch off from main cavity 56 and extend from the main cavity to the rear face 60 of central block 50. Side exhaust passageways 61 (FIGS. 1 and 4) also extend from main cavity 56 to the outside of central block 50 at both sides.

The piston control means or valve 62 is positioned within the main cavity 56 adjacent to the exhaust and supply passageways 58, 61, and 59. The piston control means is shown in detail in FIG. 4.

A sleeve 63 extends within the top portion of main cavity 56 and is provided with openings which correspond to the exhaust and supply passageways 58, 61 and 59 respectively. A valve piece 64 is slidably received by sleeve 63. Valve piece 64 has an enlarged plug portion 65 which slides downwardly within sleeve 63 and closes off piston exhaust passageway 58 and the two side exhaust passageways 61.

Valve piece 64 is also provided with a stem receptacle 66 at its lower end. Stem receptacle 66 receives valve stem 67 therein in a slidable relationship. When the valve piece 64 is depressed sufficiently far, the end of valve stem 67 is contacted by the closed end of stem receptacle 66. The valve stem 67 is thereby moved downwardly against the force of spring 57 to be unseated from the end of sleeve 63. Compressed gas is then free to flow to piston supply passageway 59. Sleeve 63 and valve piece 64 are retained within main cavity 56 by a retainer plate 69 which is screwed or otherwise fastened to central block 50 as by screw 69*a*.

Figure 2:
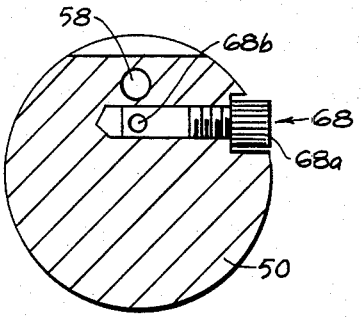
FIG. 2 is a cross-sectional view taken along line 2—2 of FIG. 5.
Figure 3:
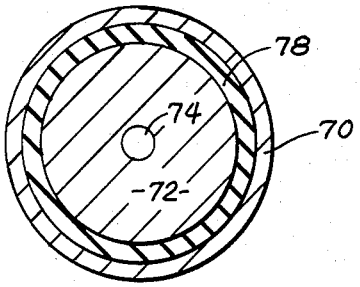
FIG. 3 is a cross-sectional view taken along line 3—3 of FIG. 6.

Compressed gas flowing through piston supply passageway 59 proceeds through a piston pressure adjustment valve 63 which is also shown in transverse cross-sectional view in FIG. 2. Piston pressure adjustment valve 68 can advantageously be a threaded bolt 68*a* which is threadably received within central block 50 and has a metering aperture 68*b* which extends through the bolt adjacent to piston supply passageway 59. By rotating bolt 68*a* the amount of available flow area of metering aperture 68*b* is adjusted to thereby control the flow of compressed gas and the resulting pressure acting upon piston 72.

FIG. 6 shows the rear portion 15 of the pneumatic puller. The rear portion includes the piston tube 70 and the rear cap 80 as parts of the structural housing 13. The rear portion 15 can also advantageously include a handle 90 to facilitate handling of the tool.

Piston tube 70 has an internal bore or cylinder 73 which is preferably cylindrical and straight so that piston 72 can easily slide therein. A piston rod 74 extends through piston rod opening 75 in piston 72, to support and align the piston within piston cylinder 73. The front end of piston rod 74 is supported within rod receptacle 76 in the rear face 60 of central block 50. The rear end of piston rod 74 is supported within rod receptacle 77 in the front face 81 of rear cap 80. Piston rod 74 smooths and enhances the sliding action of piston 72 within piston cylinder 73.

Piston 72 is preferably provided with a seal such as o-ring 78 which forms an airtight seal between the piston and the cylinder. Other alternative seals are also possible as is well known in the art.

Piston 72 is biased toward the front end of the tool by piston spring 79 or some other suitable piston biasing means. Spring 79 preferably extends over a reduced diameter section 72*a* of the piston to keep the spring in better alignment. The increased mass of piston 72 associated with portion 72*a* increases the pulling or hammering action of the piston.

When compressed air is supplied to piston 72 and cylinder 73 it first enters through a chamber 60*a* on the rear face of central block 50. Chamber 60*a* aids in the quick acceleration of piston 72.

Piston 72 slides down cylinder 73 and piston rod 74 to strike the front face 81 of rear cap 80. Air which is present on the rear side of piston 72 is allowed to escape through escape ports 85 as the piston moves rearwardly. The impact caused by piston 72 slamming into rear cap 80 provides the desired hammering or pulling action which is transmitted through structural housing 13 and point assembly 20 to the dented portion of the sheet metal or other material which is being repaired. Because of the hammering action between piston 72 and rear cap 80 it is desirable to construct these components of a hardened steel such as type 4140. Other portions of the structural housing are preferably constructed of a strong lightweight material such as aluminum.

Handle 90 is advantageously formed in a shape which is easily grasped within the operator's hands. Handle 90 is also advantageously connected to the rear cap 80 by threaded connection 91.

The manner of using the pneumatic puller will now be considered. The body repairman or other operator first prepares the dented area of a bendable sheet material by drilling a small hole (not shown) at a deep point of the dent. The pneumatic puller is connected to a source of compressed gas using gas connection means 55. Point 21 is then inserted into the previously drilled hole in the dented material and the operator presses upon the appropriate side of rocker 45 thereby causing the motor 41 to rotate. The rotation of motor 41 causes point 21 to also rotate and the threads 22 securely engage point 21 to the material being straightened. The point 21 may also be pressed and threaded directly through the sheet material without drilling a hole in many cases.

The operator then depresses valve piece 64 of the piston control means 62. The exhaust passageways 58 and 61 are closed by the enlarged plug 65. Further motion of the valve piece causes valve stems 67 to be unseated so that compressed air will flow into and through piston supply passageway 59.

The force of the compressed gas against the front face 72*b* of piston 72 causes the piston to be slammed against rear cap 80 thereby creating an impact force which is transmitted through the structural housing 13 to the point 21 and hence to the dented area of the sheet material.

When the operator releases valve piece 64, enlarged plug 65 moves upwardly so that compressed gas can exhaust through piston exhaust passageway 58 and out through side exhaust passageways 61. As the compressed gas exhausts through passageways 58 and 61, the piston spring 79 forces the piston 72 forwardly within the cylinder 73 and back into the piston shown in FIG. 6.

The operator then repeats this process of depressing the piston control means 62 as many times as necessary to produce the degree of dent removal desired. After the dent has been removed, the operator once again pushes rocker 45 to cause the motor 41 to rotate point 21 out of the sheet material. The operator is then ready to move on to another dent.

The pneumatic puller described above is manufactured according to well-known machining techniques and can be constructed of the materials suggested above or other suitable materials.

In compliance with the statute, the invention has been described in language more or less specific as to structual features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A pneumatic puller for engaging and pulling a sheet of material, comprising:

a structural housing having a front end and a rear end; the structural housing having a piston cylinder therein near the rear end;

a piston slidably positioned within the piston cylinder for travel back and fourth therein; the piston having a front end and rear end corresponding to the front and rear ends of the structural housing; piston biasing means for biasing the piston toward the front end of the structural housing;

gas connection means for connecting a source of compressed gas to the pneumatic puller;

piston control means for controlling the flow of compressed gas to the piston and piston cylinder;

a point assembly rotatably mounted at the front end of the structural housing for engaging the sheet of material;

pneumatic motor means mounted to the structural housing near the front end thereof and adapted to rotate the point assembly in either direction;

pneumatic motor control means for controlling the pneumatic motor means to turn in either direction or be stationary.

2. The pneumatic puller of claim 1 wherein the structural housing includes a central block centrally located between the piston cylinder and the pneumatic motor means;

and wherein the piston control means comprises:

a main cavity within the central block, the main cavity being pneumatically connected to the gas connection means;

at least one exhaust passageway pneumatically connected with the main cavity;

a piston supply passageway within the central block and intersecting the main cavity to supply compressed gas to the piston and piston cylinder;

piston control means mounted within the main cavity; the piston control means having an enlarged plug for adjustably preventing gas from escaping from the main cavity through the exhaust opening; the piston control means also having a valve stem for sealing across the main cavity at a point between the gas connection means and the piston supply passageway.

3. A dent removing pneumatic puller for engaging and pulling bendable sheet material, comprising:

a piston tube having a front end and a rear end and having a piston cylinder therein;

a piston slidably positioned within the piston cylinder;

a rear cap attached to the rear end of the piston tube;

a central block attached to the front end of the piston tube; the central block having internal passageways therein for conveying compressed gas therethrough; the central block also having piston control means for controlling the flow of compressed gas to the piston and piston cylinder for driving the piston against the rear cap;

pneumatic motor means connected to the central block and receiving compressed gas therefrom; the pneumatic motor means including pneumatic motor control means for controlling the pneumatic motor means to turn in either direction or to be stationary; and a rotatable point assembly connected to the pneumatic motor means for rotation therewith; the point assembly having threads thereon for engaging the bendable sheet material.

4. The pneumatic puller of claim 3 further comprising:

a motor casing attached to the central block for encasing the pneumatic motor means and for acting as a structural component of the pneumatic puller; and a front cap attached to the motor casing for rotatably supporting the point assembly therein.

5. The pneumatic puller of claim 3, further comprising a piston rod supported between the central block and the rear cap for slidably supporting the piston thereon.

6. The pneumatic puller of claim 3 further comprising piston biasing means for biasing the piston toward the central block.

7. The pneumatic puller of claim 5 further comprising piston biasing means for biasing the piston toward the central block.

8. The pneumatic puller of claim 3 further comprising:

a motor casing attached to the central block for encasing the pneumatic motor means and for acting as a structural component of the pneumatic puller;

a front cap attached to the motor means casing for rotatably supporting the point assembly therein;

a piston rod supported between the central block and the rear cap and extending through a rod opening in the piston, for slidably supporting the piston thereon; and piston biasing means for biasing the piston toward the central block.

9. The pneumatic puller of claim 8 wherein the piston biasing means is a spring extending between the rear cap and the piston.

10. The pneumatic puller of claim 8 wherein the central block includes:

gas connection means for connecting a source of compressed gas to the pneumatic puller; and a piston pressure adjustment valve for controlling the pressure of compressed gas supplied to the piston and piston cylinder.

11. A pneumatically powered dent removing puller for engaging and pulling dents from sheet metal, comprising:

(a) a structural housing having a front end and a rear end and comprising:

(i) a piston tube having front and rear ends and an internal piston cylinder;

(ii) a rear cap attached to the rear end of the piston tube;

(iii) a central block attached to the front end of the piston tube and adapted to receive and distribute compressed gas through passageways contained therein;

(iv) a motor casing having a front end and a rear end and attached to the central block at the rear end thereof; and (v) a front cap attached to the motor casing at the front end of the motor casing;

(b) a piston slidably positioned within the piston cylinder of the piston tube; the piston having a rod opening therethrough;

(c) a piston rod extending between the rear cap and central block and through the rod opening of the piston, for aligning and slidably supporting the piston thereon;

(d) piston biasing means for biasing the piston toward the front end of the piston tube;

(e) pneumatic motor means connected to the control block and encased by the motor casing; the motor means having an output shaft which is rotatable; the pneumatic motor means including a motor means control for controlling whether the output shaft turns in either direction or is stationary; and (f) a point assembly rotatably mounted within the front cap and engaged by the motor means output shaft for rotation thereby; the point assembly having a threaded point to engage the sheet metal.

* * * * *